US009816771B2

(12) United States Patent
Ghitti

(10) Patent No.: US 9,816,771 B2
(45) Date of Patent: Nov. 14, 2017

(54) THUMB-OPERABLE FIREARM

(71) Applicant: Francesco Ghitti, Gardone Val Trompia (IT)

(72) Inventor: Francesco Ghitti, Gardone Val Trompia (IT)

( * ) Notice: Subject to any disclaimer, the term of this patent is extended or adjusted under 35 U.S.C. 154(b) by 0 days.

(21) Appl. No.: 15/037,176

(22) PCT Filed: Nov. 18, 2014

(86) PCT No.: PCT/IB2014/066120
§ 371 (c)(1),
(2) Date: May 17, 2016

(87) PCT Pub. No.: WO2015/071886
PCT Pub. Date: May 21, 2015

(65) Prior Publication Data
US 2016/0282073 A1 Sep. 29, 2016

(30) Foreign Application Priority Data
Nov. 18, 2013 (IT) ..... BS2013A0170

(51) Int. Cl.
*F41A 19/07* (2006.01)
*F41A 17/24* (2006.01)
*F41C 23/20* (2006.01)

(52) U.S. Cl.
CPC ..... *F41A 19/07* (2013.01); *F41A 17/24* (2013.01); *F41C 23/20* (2013.01)

(58) Field of Classification Search
CPC ..... F41A 19/07; F41A 17/24; F41C 23/20
USPC ..... 42/69.01
See application file for complete search history.

(56) References Cited

U.S. PATENT DOCUMENTS 1,230,973 A * 6/1917 Yeaton ..... F41A 19/07 42/41
1,362,478 A * 12/1920 Deitrich ..... F41A 17/52 42/43
1,372,763 A 3/1921 Ludovic
1,582,533 A 4/1926 Packard, Jr.
1,839,621 A * 1/1932 Onorati ..... F41A 9/23 42/17
2,977,703 A * 4/1961 Sarvis ..... F41A 19/07 42/1.11
3,210,879 A * 10/1965 La Rue ..... F41A 19/07 42/69.01
4,010,566 A * 3/1977 Edwards ..... F41A 19/07 42/41
4,070,783 A * 1/1978 Edwards ..... F41A 19/07 42/69.01

(Continued)

FOREIGN PATENT DOCUMENTS

FR 2588369 A1 4/1987
WO 2009000218 A2 12/2008

*Primary Examiner* — Joshua Freeman
(74) *Attorney, Agent, or Firm* — Volpe and Koenig, P.C.

(57) ABSTRACT

A firearm (1), for example a pistol or a rifle, is described, wherein the drive mechanism (5) of the firing pin (6) is controlled by a trigger (T), a key or a button, laterally positioned on the firearm (1) and operable by the hand thumb. The firearm, with respect to the known art, is characterized by a reduced aiming distance (d1), which is the distance between the index finger (f1) and the longitudinal axis (X) of the barrel (2). This leads to a reduced recoil.

9 Claims, 14 Drawing Sheets

(56) References Cited

U.S. PATENT DOCUMENTS

| | | | | |
|---|---|---|---|---|
| 5,560,133 | A * | 10/1996 | Kuebler | F41A 17/22 42/69.01 |
| 8,234,978 | B1 * | 8/2012 | Bond | F41A 19/07 102/275.11 |
| 8,984,788 | B2 * | 3/2015 | O'Clair | F41A 11/02 42/41 |
| 9,316,455 | B2 * | 4/2016 | Hirschheiter | F41A 19/10 |
| 2012/0096752 | A1 * | 4/2012 | Lee | F41A 19/10 42/69.01 |
| 2013/0000171 | A1 * | 1/2013 | da Silveira | F41A 19/12 42/69.01 |
| 2013/0340309 | A1 * | 12/2013 | Lee | F41A 19/10 42/69.01 |
| 2015/0211822 | A1 * | 7/2015 | Hirschheiter | F41A 19/10 42/69.01 |
| 2016/0282073 | A1 * | 9/2016 | Ghitti | F41A 19/07 |

* cited by examiner

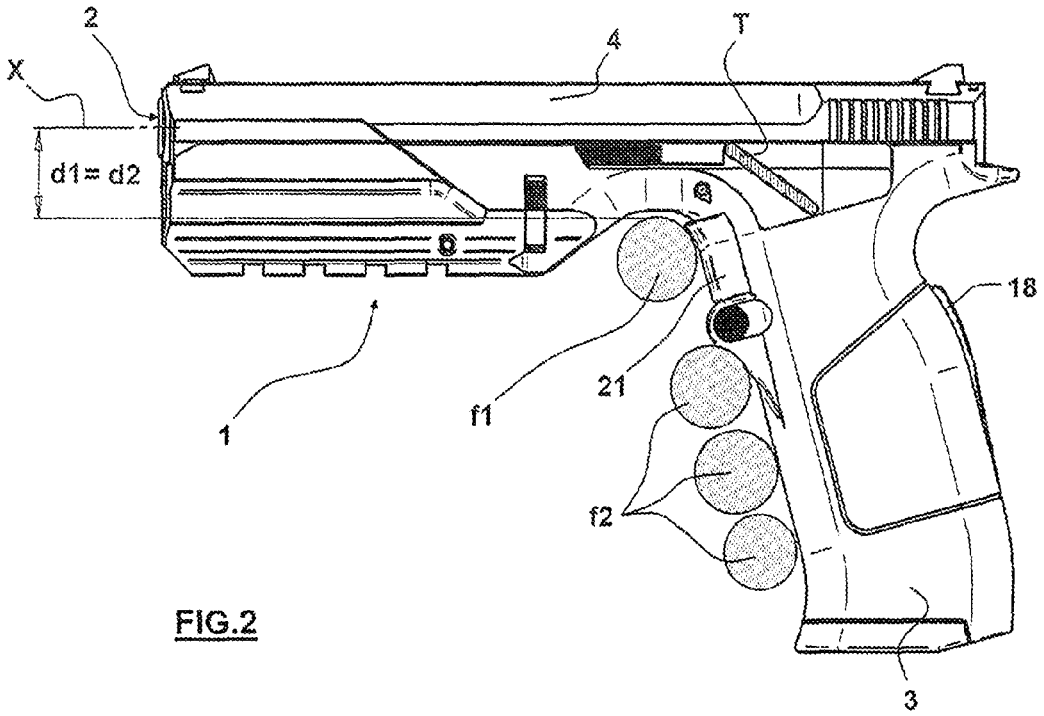
FIG.2
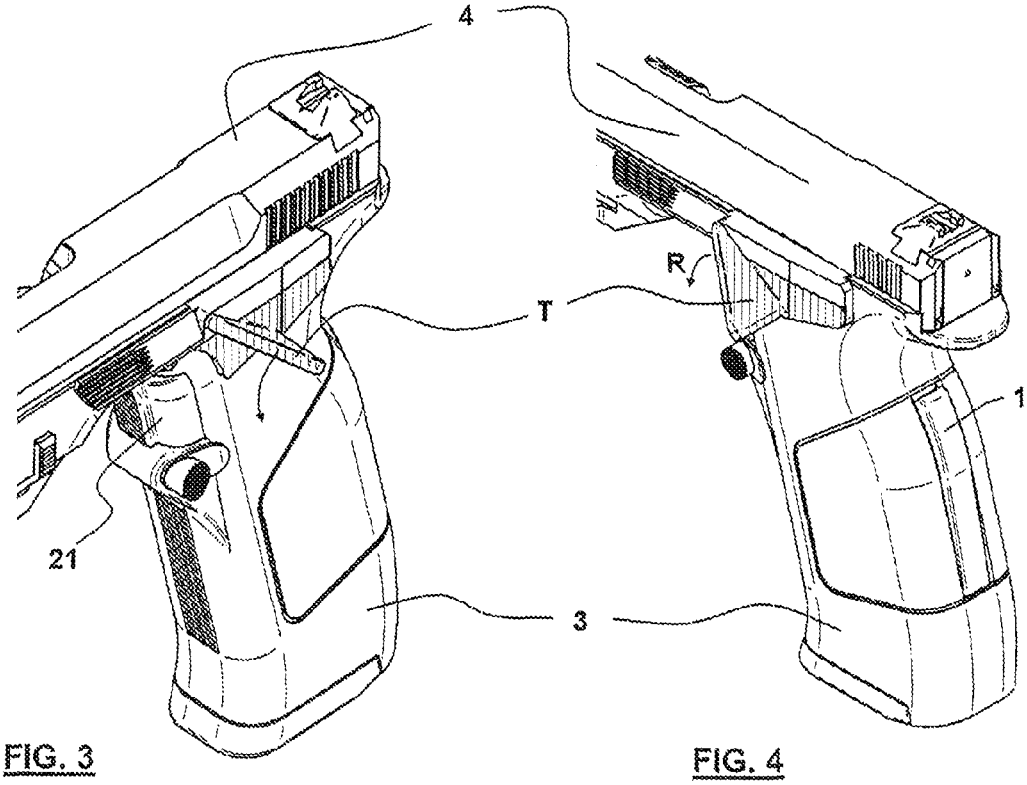
FIG. 3
FIG. 4

THUMB-OPERABLE FIREARM

FIELD OF THE INVENTION

The present invention relates to a firearm, which could be both long—as rifles—and short—like guns—, without the traditional trigger intended to be pressed by the index finger, and provided with thumb-operable means.

STATE OF THE ART

In the scope of the present invention, the expression 'firearm' is used to indicate all portable weapons, provided with a barrel, firing a bullet by the action of a firing pin activating the corresponding charge. As known, a small charge, or primer, is encapsulated in the bullets and, when suddenly compressed by the firing pin of the weapon, it explodes. The expansion of gases generated by the explosion pushes the bullet into the firearm barrel until ejecting it at high speed.

Firearms are defined "long" if intended for long distance shooting; these arms have a long barrel and they are shouldered by using both hands, and almost always using the shoulder as a support when taking aim and shooting. According to this definition, rifles are in fact long firearms.

Firearms are defined "short" if intended especially for a personal use against short distance targets; these firearms have a short barrel and usually are grasped using only one hand. According to this definition, guns and some machine-guns are in fact "short" firearms.

Currently, the butt, which allows to grip the firearm, extends from the main body that the afore said firearms are provided with; on the main body the barrel of the firearm is also mounted, which can be smooth or ribbed, and the breech, constituting the seat in which the bullets are loaded and where the respective primer is activated by the firing pin. The breech converges in the barrel to allow the bullet to be ejected forward. The firing pin is translatable in a corresponding seat between a backward position, at which it does not interfere with the bullet loaded in the breech, and a forward position, at which it is in abutment against the bullet loaded at the primer thereof. Usually, the firing pin is spring loaded in advance and blocked in a backward position.

The firearm is driven by means of a lever, usually called trigger, cantileverly extending from the firearm body and intended to be pushed by the index finger towards the butt. The firing pin release is controlled by the trigger through a kinematic system (i.e. an assembly of levers and/or cams and/or springs, etc.), either directly or by functionally interposing the firearm hammer, if the latter is present. Once released, the firing pin is pushed against the bullet, thus causing the primer explosion and the bullet to be discharged from the barrel itself.

For example, WO 2009/000218 describes a typical drive mechanism of a semi-automatic gun. Referring to FIG. 6, the firing pin is referred to by numeral 39 and the trigger by 12.

In traditional solutions, the overall bulk of the kinematic system functionally interposed between the trigger and the firing pin, or between the trigger and the firearm hammer, represents a drawback. Since the body of the gun houses the kinematic system, between the trigger and the breech, the greater is its overall dimension, the greater is the distance between the barrel and the trigger.

FIG. 1 shows a schematic side view of a traditional gun 1' provided with a barrel 2' and a butt 3', allowing the user to grasp the firearm. The gun 1' is provided with a traditional T-shaped trigger cantileverly extending downward, substantially parallel to the butt 3'. The trigger is designed to be pressed, i.e. pushed towards the butt 3', by the first finger f1; the butt 3' is designed to be grasped in the hand by the other fingers f2. The distance d1 between the first finger and the longitudinal axis of the barrel 2' is defined as 'aiming distance' or 'line of fire'. The distance d2 between the middle finger and the longitudinal axis of the barrel 2' is defined as 'strong-grasp distance'.

In conventional firearms, the aiming distance d1 is generally greater than 33 mm, generally equal to about 45 mm.

The strong-grasp distance d2 is mostly between 55 mm and 65 mm. The greater the strong-grasp distance d2 is, the more tangible and intense the firearm recoil after a shot is. In fact, during firing, as a result of the charge in the bullet being triggered, a reaction force F parallel to the forward direction of the bullet, i.e. parallel to the axis of the barrel 2', is generated, and is directed towards the user. De facto, the strong-grasp distance d2 is the arm of the force F; as a result, a moment $M=F\times d2$ is generated which, according to right-hand rule, tends to raise the barrel upward. The accuracy of the shot can be negatively affected by this phenomenon.

It is therefore desirable to minimize the distance d2.

Document FR 2588369 describes a firearm provided with a trigger positioned laterally to the butt, on the right and left thereof. The trigger is rotatable around an axis orthogonal to the firearm barrel to be operated by the thumb of the hand. The firearm has not the traditional trigger operable by the index finger.

U.S. Pat. No. 1,372,763 describes another solution known in the art.

SUMMARY OF THE INVENTION

It is therefore an object of the present invention to provide a firearm able to simply and effectively solve the drawbacks of the traditional solutions, being at the same time simple to be manufactured and safe for the user.

These and other objects are obtained by a firearm according to claim 1.

In particular, the present invention relates to a firearm, for example a gun or rifle, comprising a main body; a barrel and a butt (or handle, or helve) are constrained to the main body.

In the firearm there is a seat wherein the firing pin is housed. The latter is translatable between a backward position, at which it does not interfere with the bullet loaded in the barrel and the firearm is at rest, and a forward position, at which the firing pin is in abutment against the bullet loaded in the barrel thus activating its primer.

The firearm comprises a drive mechanism of the firing pin, i.e. a mechanism operating to control the displacement of the firing pin under control of the user, i.e. the person grasping the firearm. The drive mechanism comprises in its turn a trigger and levers and/or gears and/or elastic elements.

The firearm is different from the known art because the trigger is positioned on a firearm side, substantially laterally with respect to the barrel or butt, to be pushed by the thumb of the hand.

In other words, the firearm according to the present invention is free of the traditional trigger that substantially extends cantileverly from the firearm body in parallel to the butt and downward, in the median plane of the firearm itself.

In the firearm according to the present invention, the butt is shaped so as to be tightened in the hand by the index, middle, ring and little fingers. Indeed, the index finger, not having to push any trigger, can be used to grasp the butt.

Preferably, the trigger is positioned at the upper portion of the butt, just below the longitudinal axis of the barrel.

This technical solution offers several advantages.

First of all, the vertical bulk of the drive mechanism is minimized with respect to what is found in firearms available nowadays.

For example, the suggested solution allows the firearm to be made with a structure such that the distance between the longitudinal axis of the barrel and the rotation axis of the trigger is shorter than 20 mm, and preferably shorter than 15 mm.

In particular, the distance d1 is shorter than or equal to 20 mm, thus obtaining a firing line particularly low and therefore very accurate.

The described configuration gives an advantage also to the previously defined strong-grasp distance d2 which, being the same as the aiming distance d1 (d2=d1), turns out to be shorter than or equal to 20 mm. The recoil effect is thus minimized because the arm d1 of the fire force is shorter with respect to traditional solutions. All this promotes fire accuracy which is maximized with the other conditions unchanged.

Gripping the butt also by the first finger gives the additional advantage of strength and safety higher than traditional solutions, in which the first finger does not contribute to the grip but is used to press the trigger.

As clearly understood by the field technician, the trigger is positioned on the left side or the right side of the firearm, depending on whether the user is right- or left-handed, respectively. In an alternative solution the firearm has two triggers, one on each side.

Preferably, the trigger is rotating with respect to the body of the firearm on a rotation axis 90° skew with respect to the longitudinal axis of the barrel. The rotation axis is preferably in-between the longitudinal axis of the barrel and the butt, right in order to minimize the bulk.

In an embodiment of the present invention the firearm is a gun.

Advantageously, in addition to the trigger, the drive mechanism comprises a drive shaft fixed to the trigger and rotating on its rotation axis, a thrust cam, fixed to the drive shaft, a main lever having a first end hinged to the main body of the firearm, a thrust lever pivoted to the main lever at the second end, and a snap lever, pivoted to the main body and pivoted to the thrust lever and provided with means for temporarily retaining the firing pin. The rotation of the trigger leads to an equal rotation of the drive shaft connected thereto and of the thrust cam, the latter in its turn rotationally pushing the main lever in the opposite way; the rotation of the main lever leads to a corresponding roto-translation of the thrust lever, the latter in its turn rotationally pushing the snap lever up to cause the disengagement thereof from the firing pin. A spring of the firing pin applies a force to the firing pin itself, which is free to translate in the respective seat, pushing it against the bullet in the barrel. De facto, the firing pin is immobilized by the thrust lever that counters the spring action until the user operates the drive mechanism of the firearm, thereby releasing the firing pin.

Preferably, the firearm comprises more springs countering the rotation of the trigger and the snap lever. These springs are also used for returning the respective elements in the initial position in order to be activated again.

Preferably, the gun comprises at least another safety mechanism, or safety catch, having the purpose to inhibit the drive mechanism. The safety mechanism comprises in its turn at least one of the following solutions, or both of them.

In a first embodiment, the safety mechanism comprises a safety lever pivoted to the butt and rotating with respect thereto at its back portion, that is the portion facing the user when he/she grasps the firearm. Moreover, an elastic element countering the rotation of the safety lever is provided. In a first configuration, an end of the safety lever engages the snap lever and prevents the rotation thereof, and hence it prevents the activation of the firing pin. In a second configuration, the safety lever does not engage the snap lever, thereby allowing the activation of the firing pin. The switching from the first to the second configuration is caused right by the hand palm of the user when he/she grasps the butt of the firearm by overcoming the force of the countering elastic element.

In a second embodiment, the safety mechanism comprises a safety button at the front and upper portion of the butt, where the first finger is expected to be placed. The button is movable by the user's first finger, between an active position, next which the button engages the trigger and prevents the rotation thereof, and an inactive position, corresponding to the button pressed towards the butt and to the disengagement of the trigger, which is therefore free to rotate.

In another embodiment of the present invention the firearm is a rifle. For this embodiment, the Applicant reserves to file a divisional application, based on claim 9, independently of what has been described relative to the gun.

Preferably, in the rifle the drive mechanism further comprises, in addition to the trigger, also a hammer pivoted to the main body. The hammer is rotating between an initial position, in which it is held by the trigger itself directly or by the interposition of other elements, and a final position contacting and pushing the firing pin, wherein the trigger does not hold the hammer, and wherein a preloaded spring pushes the hammer with violence towards the firing pin.

Preferably, the weapon comprises at least one safety mechanism inhibiting the drive mechanism, equivalent to one of the mechanisms described for the gun.

As clearly understood by the field technician, the present invention can be further applied to the field of toy weapons and weapons used in simulations, known as "Airsoft". For example also a pneumatic toy weapon, or a firearm reproduction, can be operated by a trigger positioned laterally on the firearm.

BRIEF LIST OF THE FIGURES

Further characteristics and advantages of the invention will be more evident from a review of the following specification of a preferred, but not exclusive, embodiment, shown for illustration purposes only and without limitation, with the aid of the attached drawings, in which:

FIG. 2 is a side view of a gun according to the present invention;

FIGS. 3 and 4 are perspective partial views of the gun shown in FIG. 2;

DETAILED DESCRIPTION OF THE INVENTION

Figure 1:
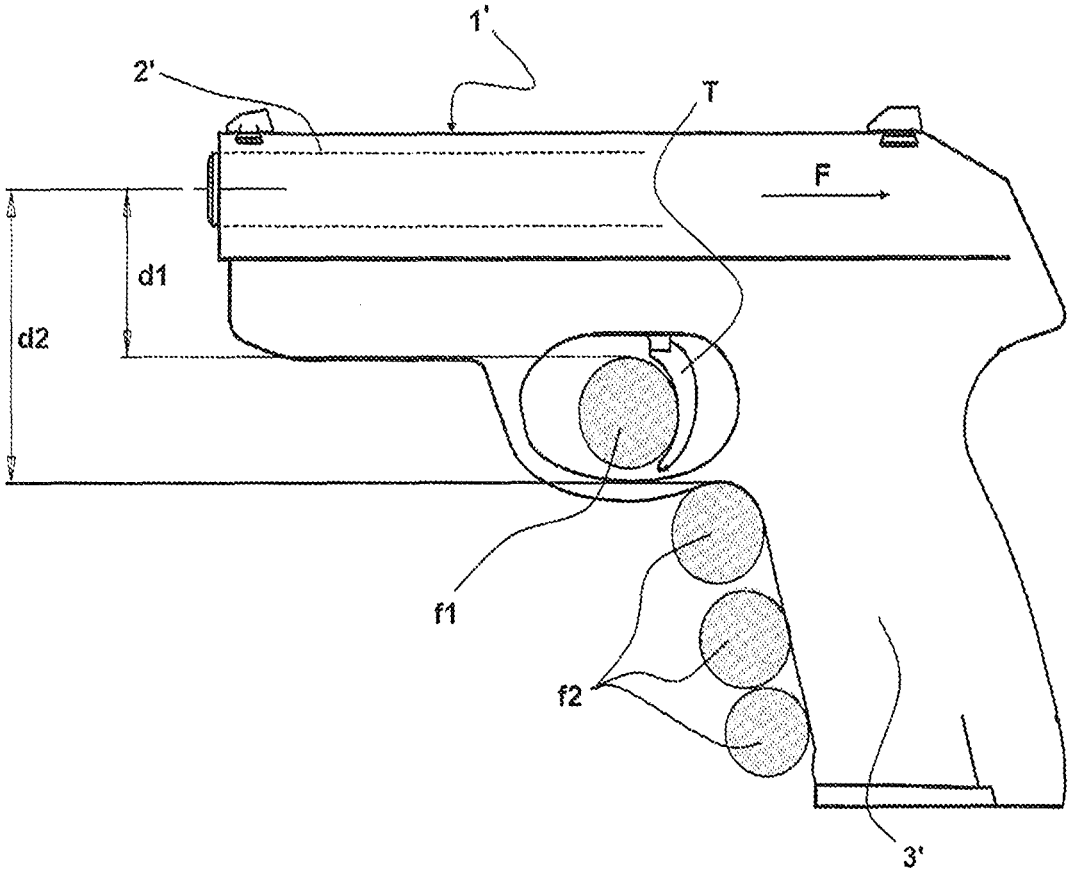
( prior art ) FIG. 1
FIG. 1 is a schematic side view of a gun according to known art.

As previously mentioned, FIG. 1 is a schematic side view of a traditional gun.

FIG. 2 shows a gun 1 according to the present invention provided with a barrel 2, having a longitudinal X axis, a slide 4, a butt or grip 3, and a trigger T positioned laterally on the firearm between the butt 3 and the slide 4.

FIGS. 3 and 4 are, respectively, partial front and rear perspective views of the gun 1, clearly showing the position and the respective bulk of the trigger T.

In FIG. 2, f1 refers to the vertical section of the first finger and 12 to the vertical section of the middle, ring and little fingers of the same hand of the user, overall. In view of the foregoing description, the trigger T is not engaged by the first finger, being conversely designed to be pressed by the thumb (not shown), i.e. rotated in the direction of the arrow R.

As will be explained with reference to the remaining figures, the trigger T controls a drive mechanism 5 of the firing pin 6 of the gun 1. With respect to traditional solutions, wherein the trigger is activated by the first finger, the vertical bulk of the drive mechanism 5 is reduced, due to the position of the trigger T on the side of the firearm 1.

In the example shown in FIGS. 1-3, the aiming distance d1 is equal to the strong-grasp distance d2 and is equal to 20 mm; the aiming distance d1 of the traditional gun 1' shown in FIG. 1, having the same caliber, is equal to about 33 mm, the distance d2 of the gun 1' is equal to 55-65 mm.

As evident, the gun 1 according to the present invention is less affected by the recoil phenomenon.

Figure 5:
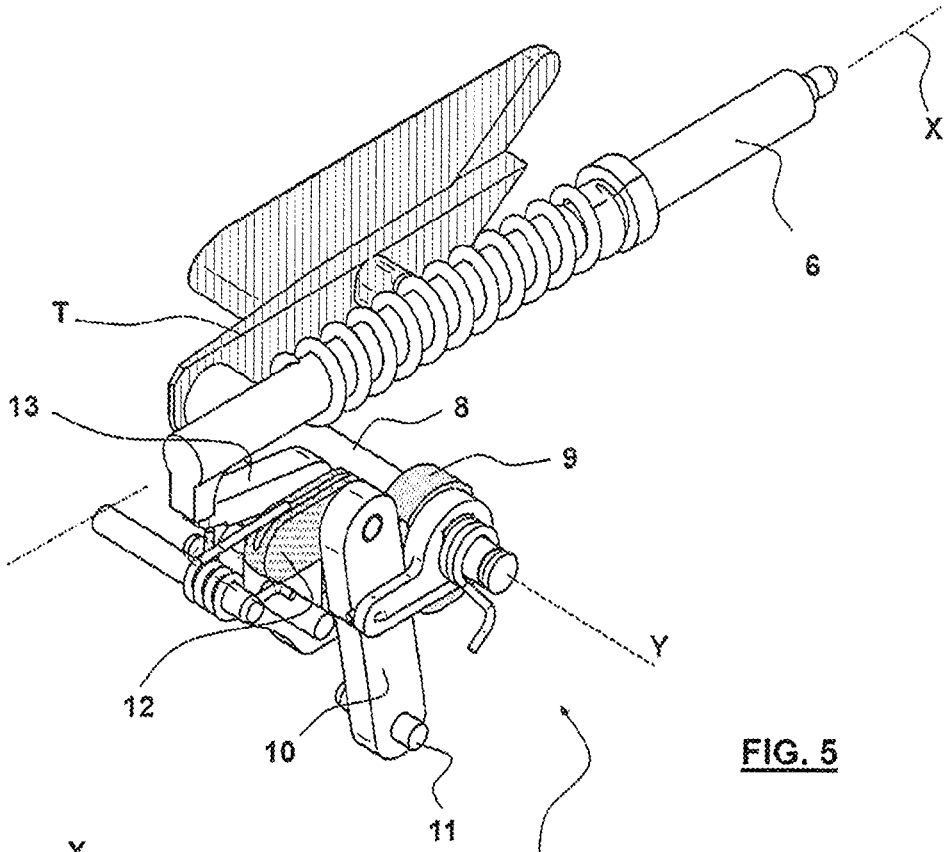
FIGS. 5 and 6 are perspective partial views of the drive mechanism of the gun shown in FIG. 2.
Figure 6:
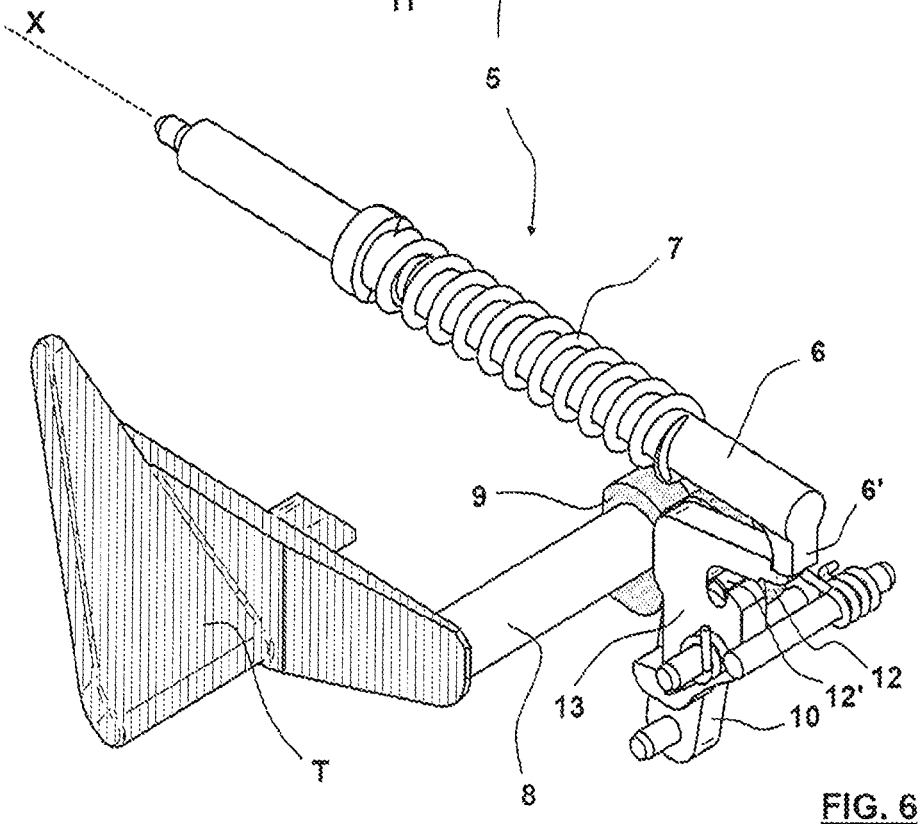

FIGS. 5 and 6 are right and left perspective views, respectively, of the drive mechanism 5 of the gun 1, which is substantially within the firearm (except for the radially projecting trigger T), and of the firing pin 6.

Figure 7:
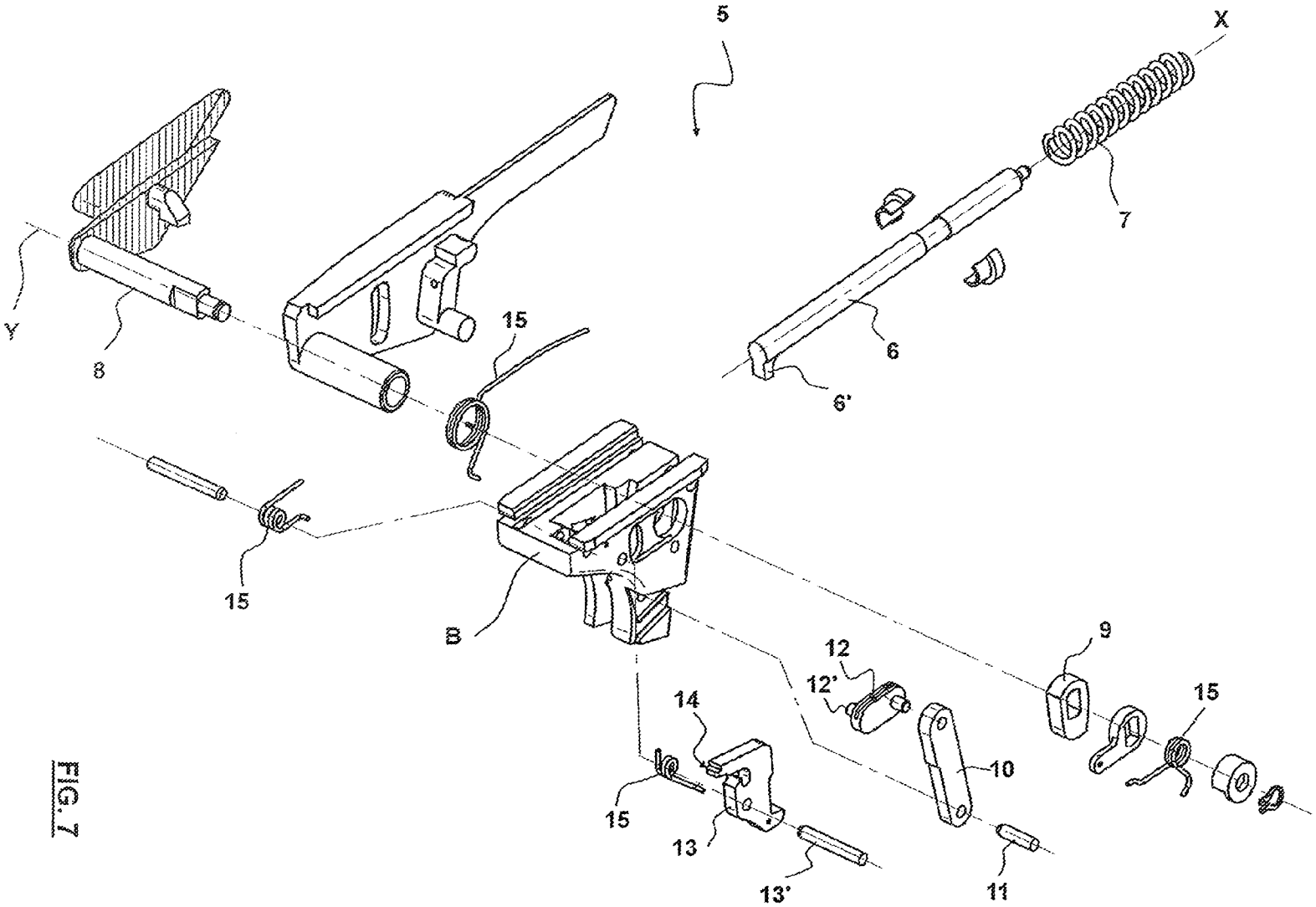
FIG. 7 is an exploded view of the drive mechanism of the gun shown in FIG. 2.

FIG. 7 is an exploded view of the drive mechanism 5 and the firing pin 6.

Referring to FIGS. 5-7, the firing pin 6 is translatable in a corresponding seat along the X axis, towards the bullet loaded in the barrel 2 or in the breech, if it is present. As the trigger T is pressed, a preloaded spring 7 pushes the firing pin 6. The drive mechanism 5 comprises, in addition to the trigger T, a drive shaft 8 fixed to the trigger T itself and rotating on the communal rotation axis Y. A thrust cam 9 is keyed to the drive shaft 8 and is shaped so as to transmit a predetermined law of motion to a main lever 10. The main lever 10 is pivoted at 11 to the main body B of the gun 1 (shown in FIG. 7). The opposite end of the main lever 10 is pivoted to a thrust lever 12. The thrust lever 12 is pivoted at 12' to a snap lever 13, the latter being in its turn pivoted to the main body B of the gun 1.

The snap lever 13 is provided with a prominence 14 shaped so as to ensure the shape coupling with a foot 6' of the firing pin 6 and holds it against the thrust of the spring 7 when the snap lever 13 is in a first angular position, corresponding to the firearm 1 at rest.

The rotation of the assembly formed by the trigger T, the drive shaft 8 and the thrust cam 9 on the Y axis, causes the main lever 10 to rotate in the opposite direction on the pin 11. The thrust lever 12 is pushed backwards and slightly rotated on the pin 12' thus leading to a corresponding rotation of the snap lever 13 up to cause the disengagement thereof from the foot 6' of the firing pin, which therefore snaps forward to activate the bullet primer.

A plurality of springs 15 are provided in order to return the drive mechanism to its initial position after a shot and to be able to operate a new shot.

The operating sequence of the drive mechanism 5 is shown in FIGS. 8A to 12C.

Figure 8A:
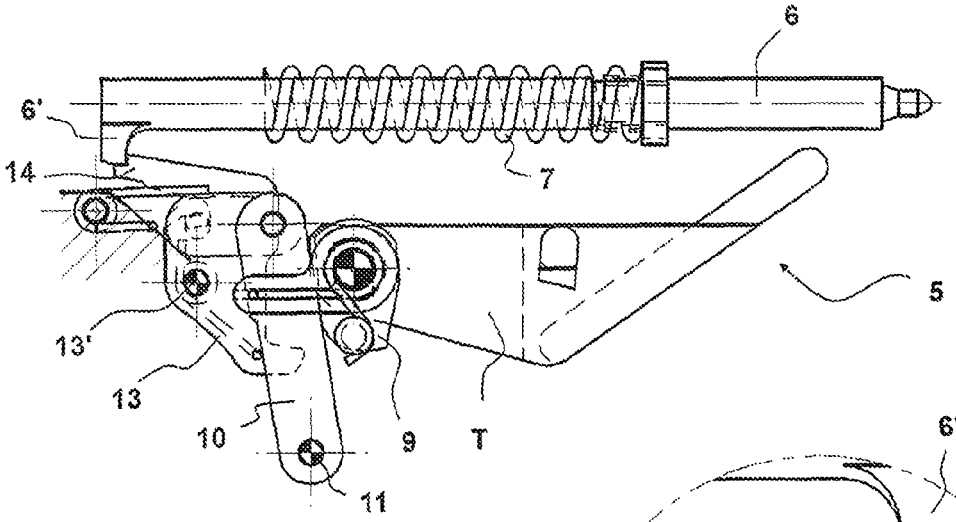
FIG. 8A is a right side view of the drive mechanism of the gun shown in FIG. 2 in a first configuration.
Figure 8B:
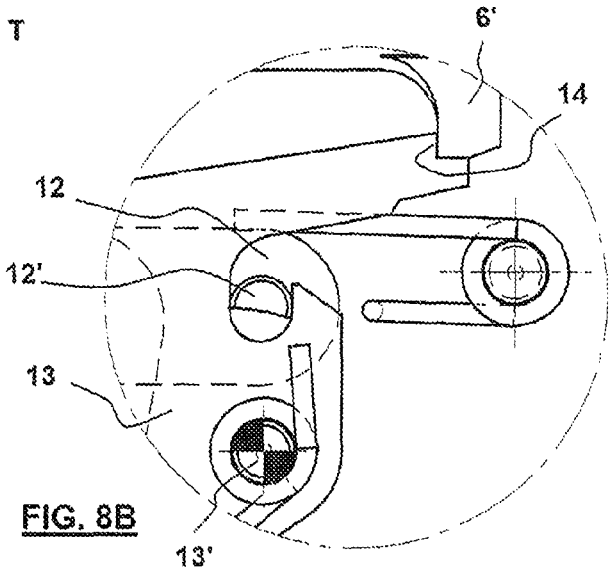
FIG. 8B is an enlargement of FIG. 8C.
Figure 8C:
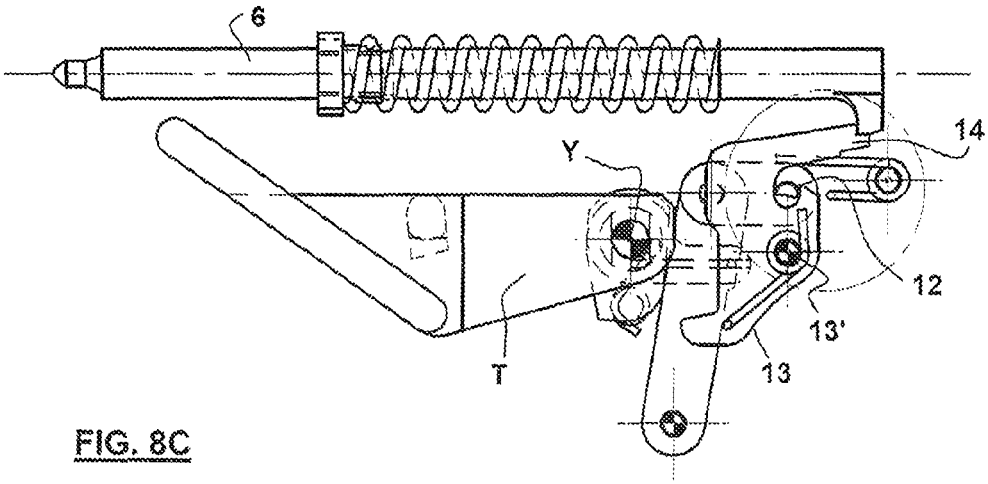
FIG. 8C is a left side view of the drive mechanism of the gun shown in FIG. 2, in the first configuration.

FIG. 8A and FIG. 8C are schematic right and left elevation views of the drive mechanism 5 and the firing pin 6. FIG. 8B is an enlargement of the encircled portion in FIG. 8C. These figures show the drive mechanism 5 at rest, before the user activates the trigger T. The prominence 14 of the snap lever 13 holds the firing pin 6 thus remaining stationary.

Figure 9A:
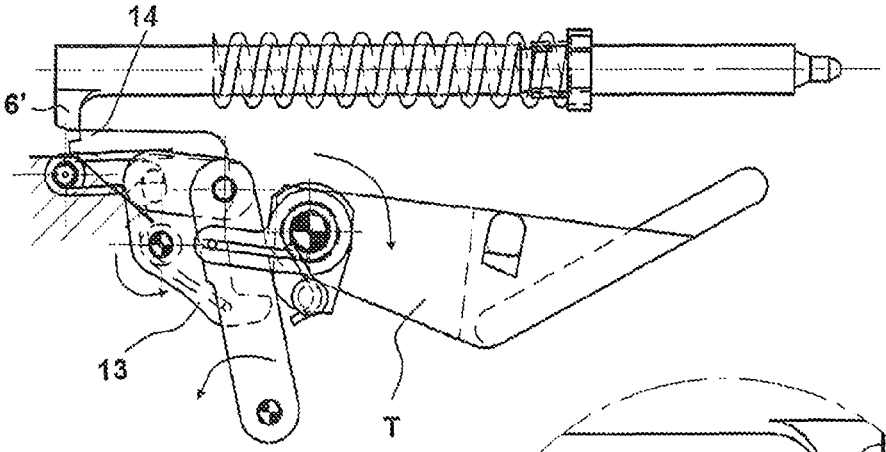
FIG. 9A is a right side view of the drive mechanism of the gun shown in FIG. 2, in a second configuration.
Figure 9B:
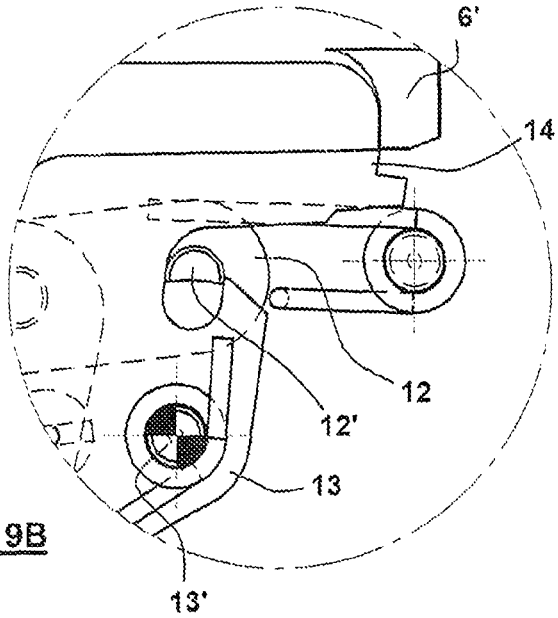
FIG. 9B is an enlargement of FIG. 9C.
Figure 9C:
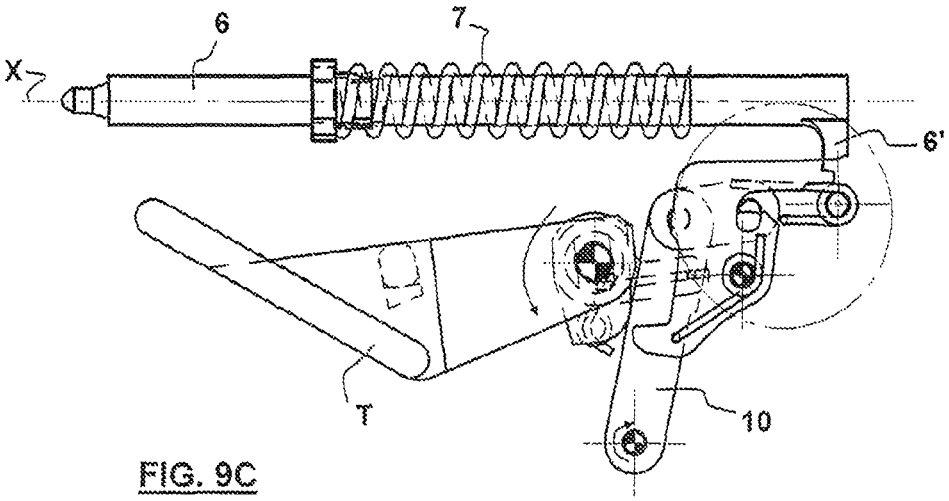
FIG. 9C is a left side view of the drive mechanism of the gun shown in FIG. 2, in the second configuration.

FIG. 9A and FIG. 9C are schematic right and left elevation views of the drive mechanism 5 and the firing pin 6, and show an instant following that respectively shown in FIGS. 8A and 8C. FIG. 9B is an enlargement of the encircled portion in FIG. 9C. These figures show the drive mechanism 5 when the user begins to press the trigger T in order to rotate it on the Y axis. The above described kinematic chain formed by the elements 8-13 leads to the rotation of the snap lever 13 on the pin 13' and to the lowering of the prominence 14. In FIGS. 9A-9C the prominence 14 has lowered and is at the limit point where the foot 6' is about to disengage.

Figure 10A:
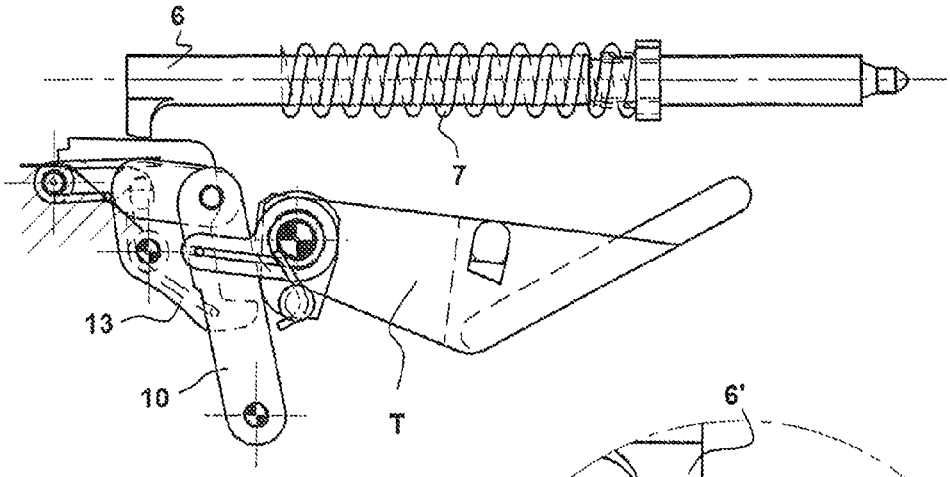
FIG. 10A is a right side view of the drive mechanism of the gun shown in FIG. 2, in a third configuration.
Figure 10B:
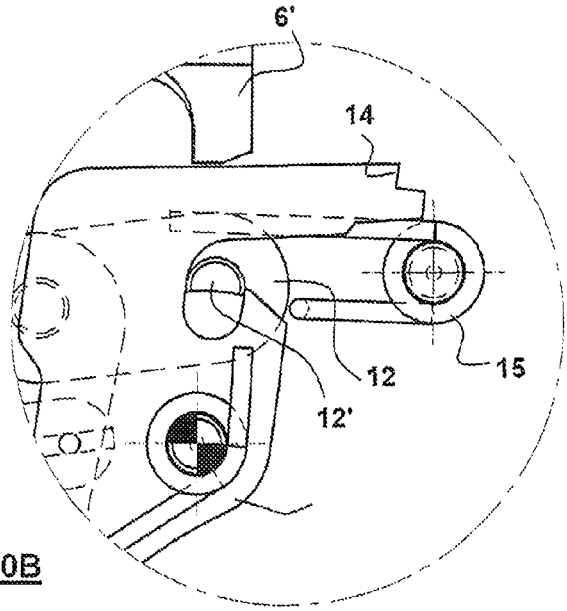
FIG. 10B is an enlargement of FIG. 10C.
Figure 10C:
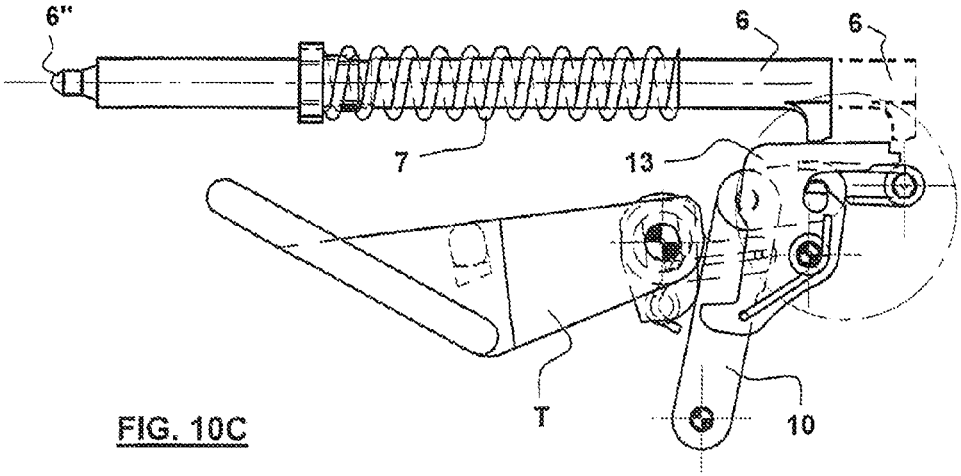
FIG. 10C is a left side view of the drive mechanism of the gun shown in FIG. 2, in the third configuration.

FIG. 10A and FIG. 10C are schematic right and left elevation views of the drive mechanism 5 and the firing pin 6, and show an instant following that respectively shown in FIGS. 9A and 9C. FIG. 10B is an enlargement of the encircled portion in FIG. 10C. These figures show the drive mechanism 5 when the snap lever 13 has further lowered up to disengage the prominence 14 from the foot 6' of firing pin 6. The latter is suddenly pushed forward by the spring 7. FIG. 10C shows in dotted line the position of the firing pin 6 when disengaging from the snap lever 13 and it can be clearly seen that the experienced forward displacement leads the tip 6" to activate the bullet primer (not shown).

Figure 11A:
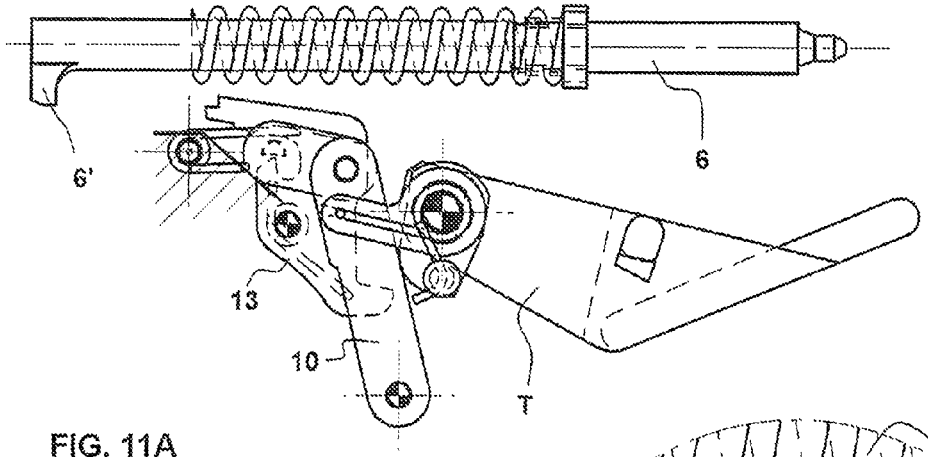
FIG. 11A is a right side view of the drive mechanism of the gun shown in FIG. 2, in a fourth configuration.
Figure 11B:
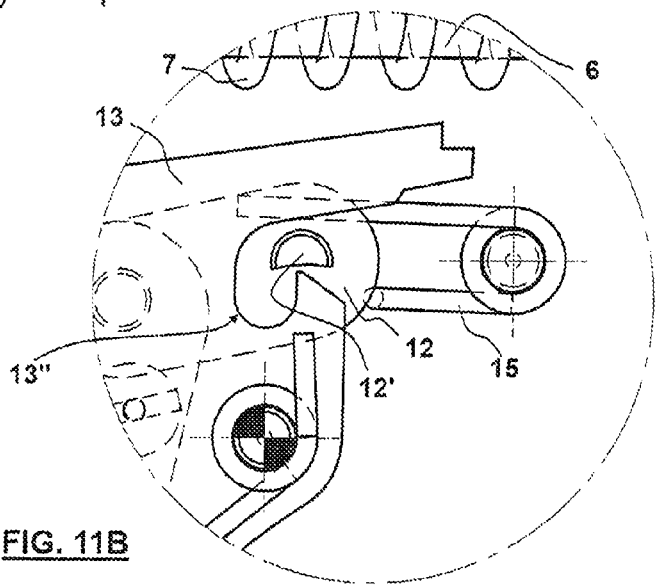
FIG. 11B is an enlargement of FIG. 11C.
Figure 11C:
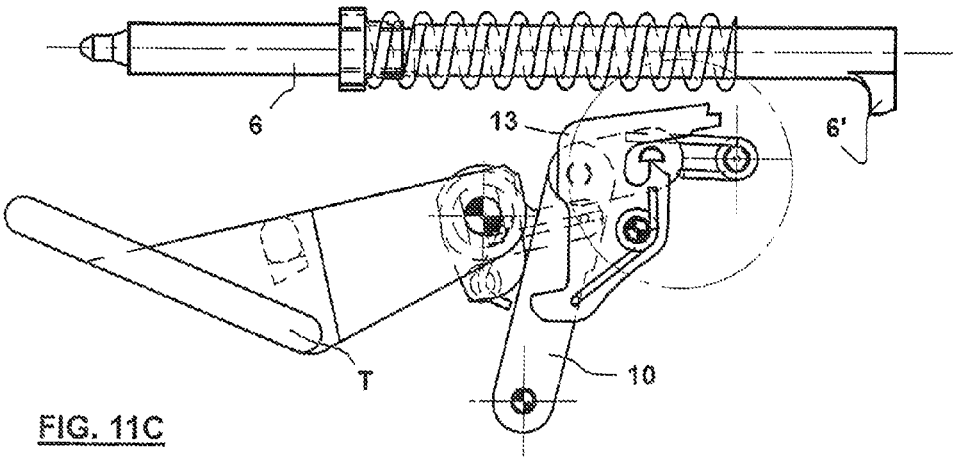
FIG. 11C is a left side view of the drive mechanism of the gun shown in FIG. 2, in the fourth configuration.

FIGS. 11A and 11C are schematic right and left elevation views of the drive mechanism 5 and the firing pin 6, and show an instant following that respectively shown in FIGS. 10A and 10C. FIG. 11B is an enlargement of the encircled portion in FIG. 11C. After the bullet primer has been activated, it is discharged from the barrel 2 of the gun 1 and the firing pin is then quickly pushed backward; the foot 6' moves back also with respect to the prominence 14 of the snap lever. A spring 15 slightly raises the thrust lever 12 just enough to release the pin 12' from the corresponding seat 13" obtained in the snap lever 13 and cause the prominence 14 to be raised in order to allows the latter to intercept the foot 6' of the firing pin returned by the spring 7.

Figure 12A:
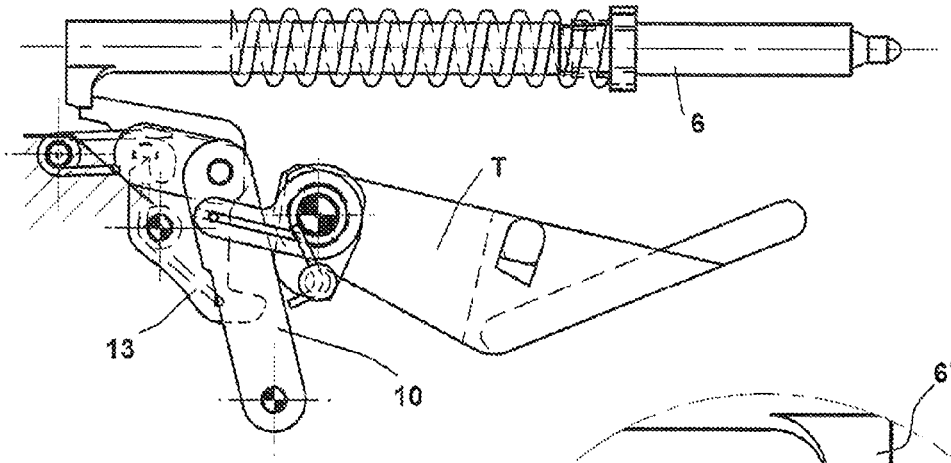
FIG. 12A is a right side view of the drive mechanism of the gun shown in FIG. 2, in a fifth configuration.
Figure 12B:
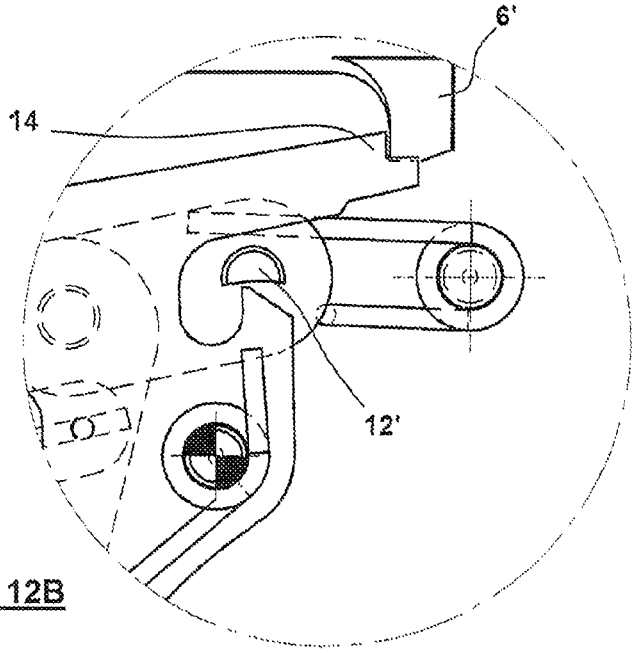
FIG. 12B is an enlargement of FIG. 12C.
Figure 12C:
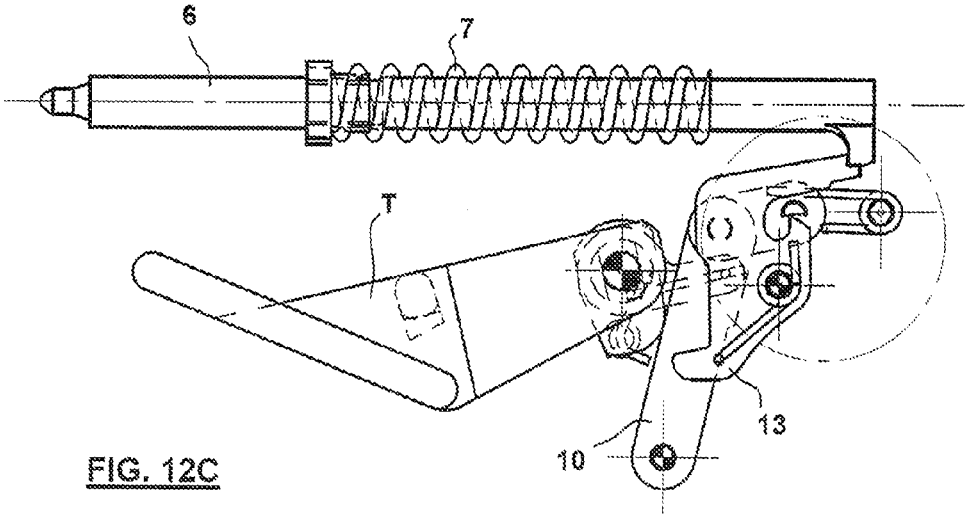
FIG. 12C is a left side view of the drive mechanism of the gun shown in FIG. 2, in the fifth configuration.

FIGS. 12A and 12C are schematic right and left elevation views of the drive mechanism 5 and the firing pin 6, and show an instant following that respectively shown in FIGS. 11A and 11C. FIG. 12B is an enlargement of the encircled portion in FIG. 12C. The firing pin 6 is returned to its initial position (corresponding to that shown in FIGS. 8A-8C) and is ready to be activated again, or to fire again. The drive mechanism 5 is also returned to the initial position.

Figure 13:
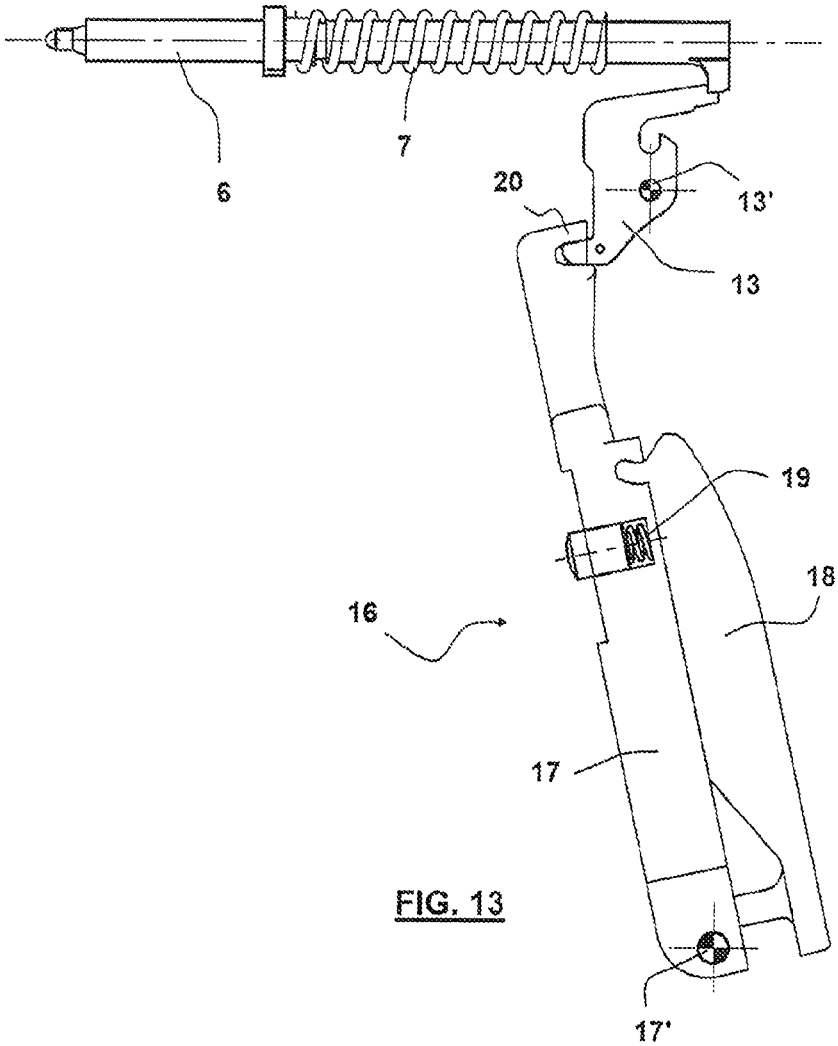
FIG. 13 is a schematic side view of a detail of the gun shown in FIG. 2.

FIG. 13 is a partial and vertical sectional view of a safety mechanism 16 preventing the snap lever 13, and thus the trigger T, from rotating if the firearm 1 is not correctly grasped by the user. The safety mechanism 16 is housed in the butt 3 of the firearm and comprises a lever 17 pivoted at 17". A cover 18 (FIGS. 2, 4 and 13) of the lever 17 protrudes backward from the butt 3 towards the user. A spring 19 counters the rotation of the lever 17. The upper end 20 of the lever 17 has a gripper shape in order to engage the snap lever 13 and prevent it from rotating. When the firearm is correctly grasped, the hand palm causes the rotation of the lever 17, clockwise in FIG. 13, leading the end 20 to disengage from the lever 13 which is free to operate, as previously described, to obtain a shot.

Figure 14:
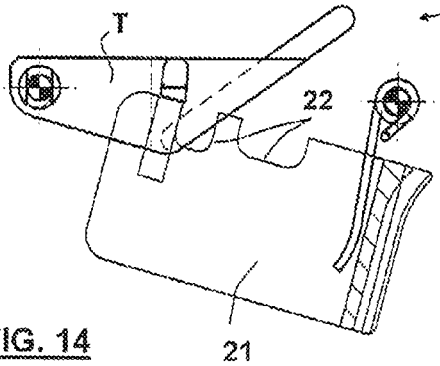
FIG. 14 is a schematic side view of another detail of the gun shown in FIG. 2.
Figure 15:
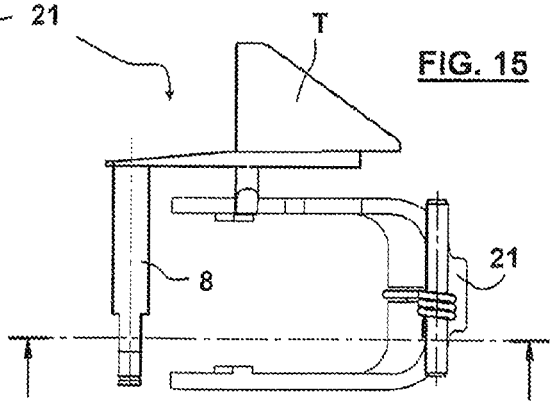
FIG. 15 is a top view of the detail shown in FIG. 14.

FIGS. 14 and 15 are schematic views, respectively a vertical section view and a plan view, of a preferably present second safety mechanism 20. Such mechanism comprises a button 21 (also shown in FIGS. 2 and 3) which protrudes frontally from the butt 3 of the gun 1 to be pressed by the first finger. The button 21 comprises seats 22 for receiving a portion of the trigger T, whereby the rotation of the trigger T is possible only when the button 21 is held down by the user and the seats 22 are aligned with the aforesaid portion of the trigger T.

Figure 16:
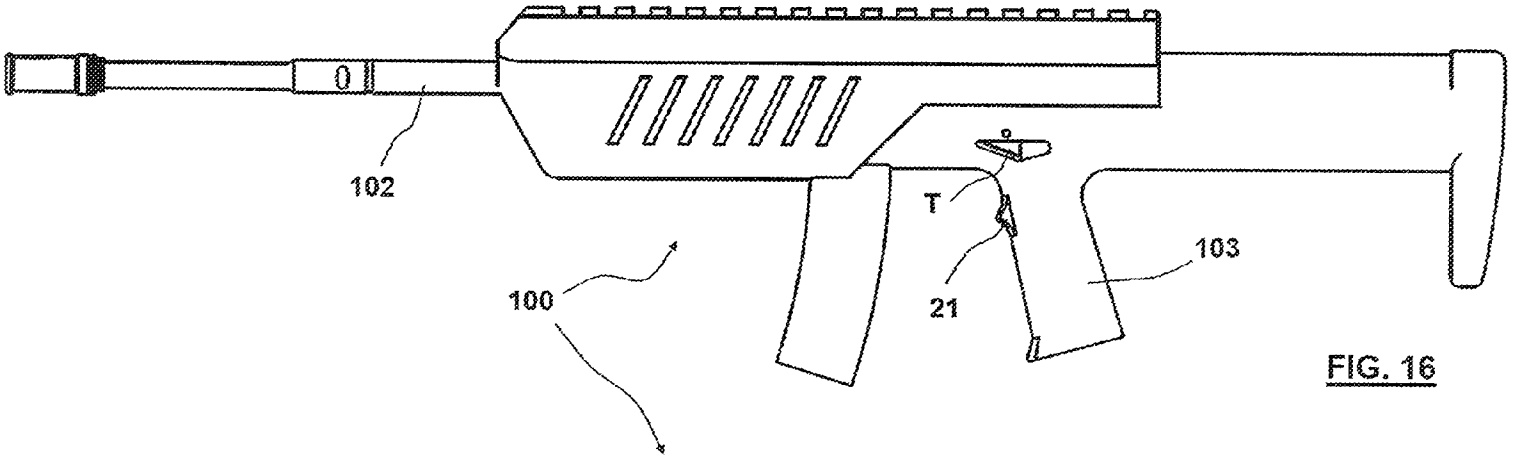
FIG. 16 is a schematic view of a first rifle according to the present invention.

FIG. 16 shows a rifle 100 according to the present invention, provided with a barrel 102, a butt 103, a side trigger T and a safety button 21 which is the same as the one above described relative to the gun 1.

Figure 17:
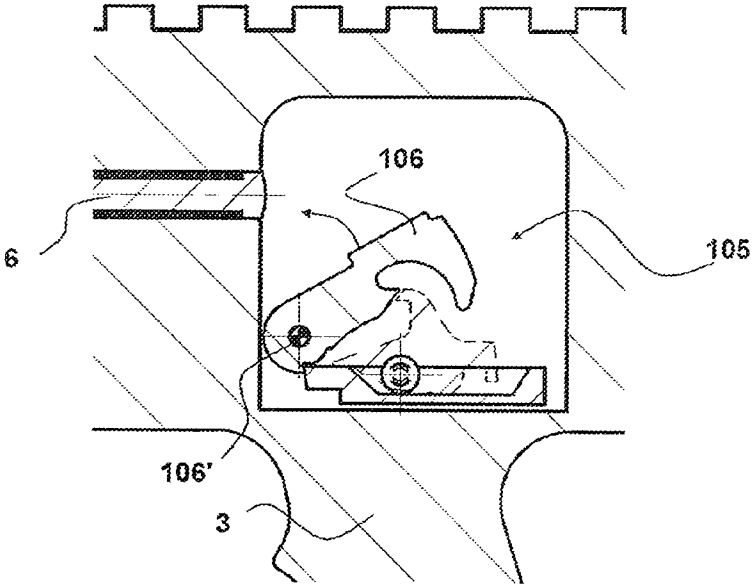
FIG. 17 is a partial and sectional view of the drive mechanism of the rifle shown in FIG. 16.
Figure 18:
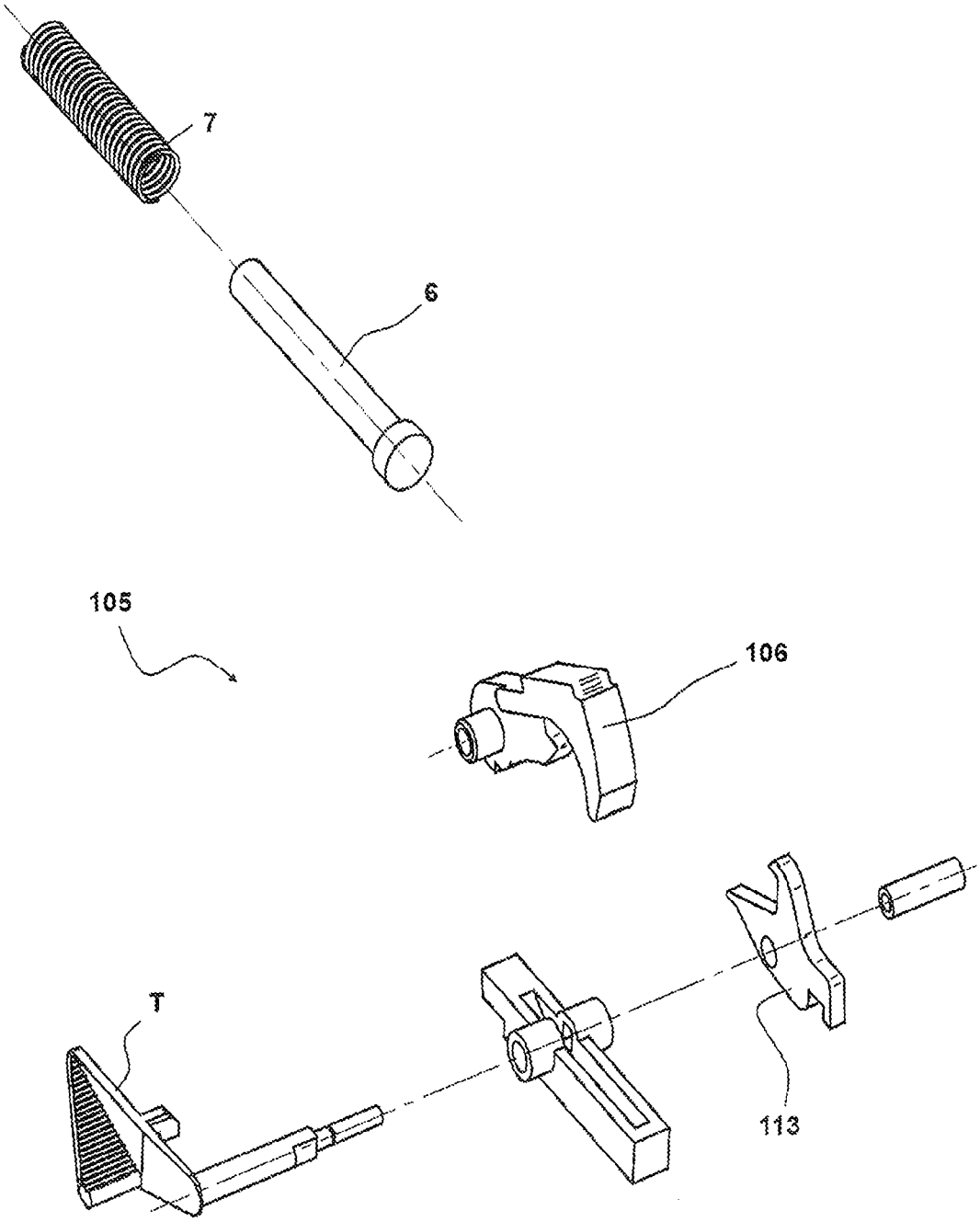
FIG. 18 is an exploded view of the drive mechanism of the rifle shown in FIG. 16.

FIG. 17 is a partial sectional view of the drive mechanism 105 and the firing pin 6 of the rifle 100. FIG. 18 is an exploded view of the mechanism 105. The trigger T causes the snap lever 113 snapping, thereby releasing a spring-loaded hammer 106; the hammer 106 rotates on its pin 106' and hits against the firing pin 6.

Figure 19:
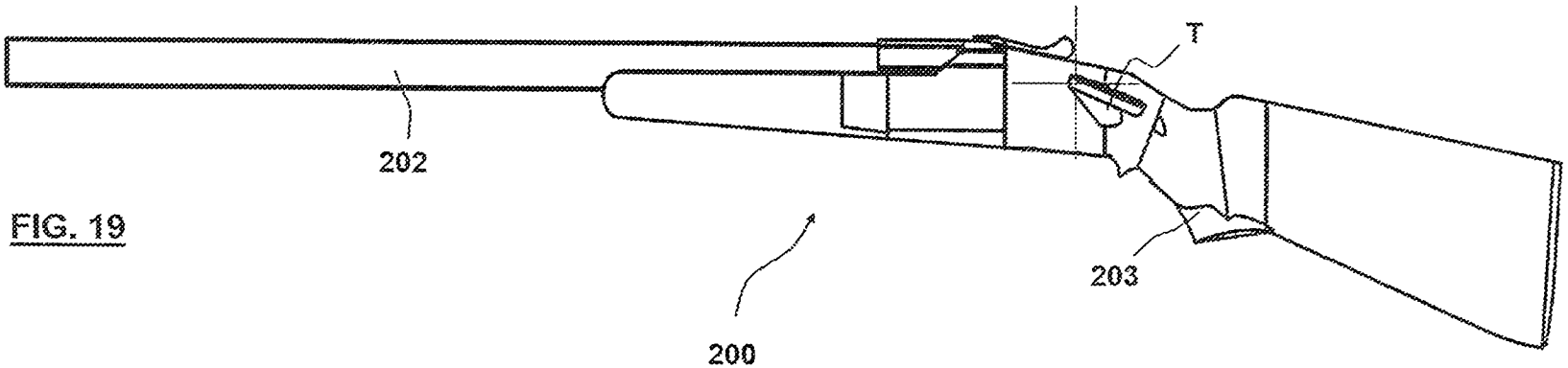
FIG. 19 is a schematic view of a second rifle according to the present invention.
Figure 20:
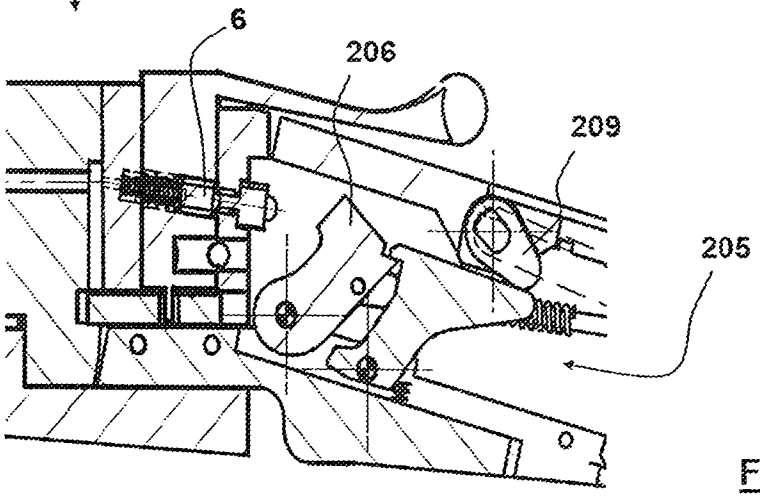
FIG. 20 is a partial and sectional view of the drive mechanism of the rifle shown in FIG. 19.
Figure 21:
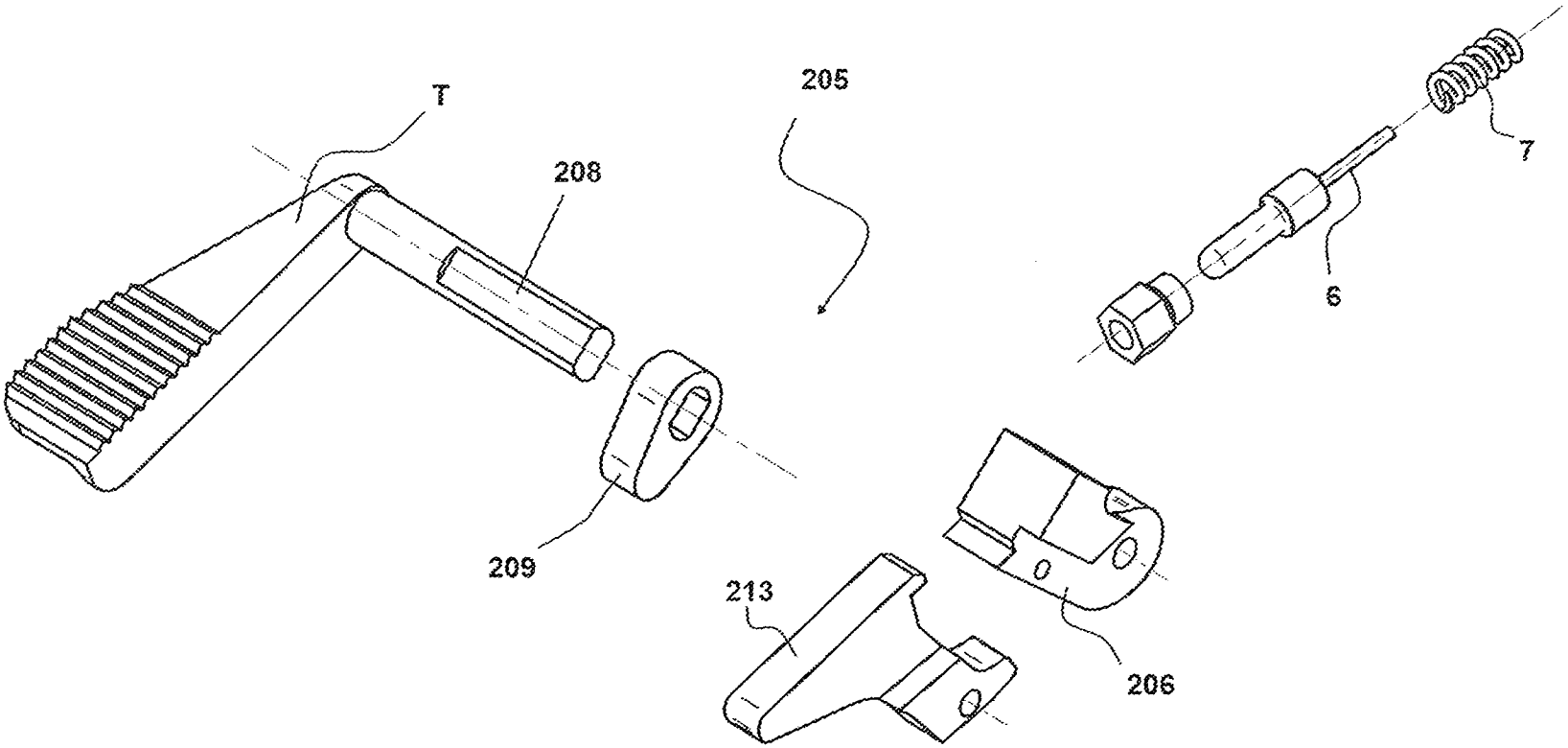
FIG. 21 is an exploded view of the drive mechanism of the rifle shown in FIG. 19.

FIGS. 19-21 refers to another type of rifle 200 according to the present invention, provided with the barrel 202, the trigger T on the firearm side and the butt 203. The drive mechanism 205 comprises a cam 209 rotating with the drive shaft 208. The cam causes the snap lever 213 to rotate until the hammer 206 is released and it suddenly rotates due to the preload of a spring until striking the firing pin 6.

As evident for a field technician, the advantages provided by the present invention can be used both in guns and in rifles.

The invention claimed is:

1. Firearm (1) comprising:

a main body (B);

a barrel (2) and a butt (3), both constrained to the main body;

a firing pin (6) translatable in a corresponding seat of the main body (B) between a backward position, at which the firing pin (6) does not interfere with a bullet loaded in the barrel (2), and a forward position, at which the firing pin (6) is in abutment against the bullet loaded in the barrel (2), in order to activate a primer thereof; and a drive mechanism (5) of the firing pin (6), comprising a trigger (T) and levers (10, 12, 13) and/or gears (8, 9) and/or elastic elements (15), wherein the trigger (T) is positioned substantially laterally to the barrel or butt (3), in order to be pressed with a user's thumb, the drive mechanism (5) comprises, in addition to the trigger (T):

a drive shaft (8) fixed to the trigger (T) and rotating on rotation axis (Y) thereof, a thrust cam (9) fixed to the drive shaft (8), a main lever (10) having a first end hinged to the main body (B) of the firearm, a thrust lever (12) pivoted to the main lever (10) at the second end, and a snap lever (13) pivoted to the main body (B) and pivoted to the thrust lever (12) and provided with means (14) for temporarily retaining the firing pin (6), wherein the rotation of the trigger (T) leads to an equal rotation of the drive shaft (8) and of the thrust cam (9), the thrust cam (9) thereby rotationally pushing the main lever (10) in an opposite way, and wherein the rotation of the main lever (10) leads to a corresponding roto-translation of the thrust lever (12), the thrust lever (12) rotationally pushing the snap lever (13) up to cause disengagement thereof from the firing pin (6).

2. The firearm (1) according to claim 1, wherein the firearm is free of a conventional trigger (T) that substantially extends cantileverly in parallel to the butt (3), in a median plane of the firearm (1) itself, and wherein the butt (3) is shaped to be tightened in a user's hand by index (f1), middle, ring and little (f2) fingers of the user's hand, and the trigger (T) is positioned at the upper portion of the butt (3).

3. The firearm (1) according to claim 1, wherein the trigger (T) is positioned on a left side or the a right side of the firearm, depending on whether the user is right- or left-handed, respectively.

4. The firearm (1) according to claim 1, wherein the trigger (T) is rotating with respect to the main body (B) of the firearm (1) on a rotation axis (Y) skew with respect to a longitudinal axis (X) of the barrel and wherein said rotation axis (Y) is in-between the longitudinal axis (X) of the barrel and the butt (3).

5. The firearm (1) according to claim 4, wherein a distance between the longitudinal axis (X) of the barrel and the rotation axis (Y) of the trigger (T) is shorter than 20 mm.

6. The firearm (1) according to claim 1, wherein an aiming distance (d1) is equal to a strong-grasp distance (d2) and is shorter than, or equal to, 20 mm.

7. The firearm according to claim 1, further comprising springs (15) configured to counter rotation of the trigger (T) and of the snap lever (13).

8. The firearm according to claim 1, comprising at least one safety mechanism (15) inhibiting the drive mechanism (5), wherein the safety mechanism (15) comprises at least one of:

a safety lever (17) pivoted to the butt (3) and rotating with respect thereto at its back portion, and an elastic element (19) countering the rotation of the safety lever (17), wherein in a first position an end (20) of the safety lever engages the snap lever (13) and prevents the rotation thereof, and hence it prevents the activation of the firing pin (6) and, in a second position, the safety lever (17) does not engage the snap lever (13), thereby allowing the activation of the firing pin (6), the switching from the first to the second position being caused by a user's palm as the user grasps the butt (3), by overcoming a force of the countering elastic element (19);

a safety button (21) at a front and upper portion of the butt (3), where the user's first finger is expected to be placed, movable between an active position, next which the button (21) engages the trigger (T) and prevents the rotation thereof, and an inactive position, corresponding to the button pressed towards the butt (3) by the first finger and to disengagement of the trigger (T), which is therefore free to rotate.

9. A rifle (100, 200) comprising:

a main body;

a barrel (102, 202) and a butt (103, 203), both constrained to the main body;

a firing pin (6) translatable in a corresponding seat of the main body between a backward position, at which the firing pin (6) does not interfere with a bullet loaded in the barrel, and a forward position, at which the firing pin (6) is in abutment against the bullet loaded in the barrel, in order to activate a primer thereof; and a drive mechanism (105, 205) of the firing pin (6), comprising a trigger (T) and levers (106, 113, 206, 213) and/or gears (209) and/or elastic elements, wherein the trigger (T) is positioned substantially laterally to the barrel (102, 202) or butt (3), in order to be pressed with a user's thumb, wherein the drive mechanism (105, 205) comprises, in addition to the trigger (T), a hammer (106, 206) pivoted to the main body and rotating between an initial position, in which the hammer (106, 206) is held by the trigger (T) directly or by the interposition of other elements (113, 213), and a final position contacting and pushing the firing pin (6), wherein the trigger (T) does not hold the hammer (106, 206), and wherein a preloaded spring pushes the hammer (106, 206) with violence towards the firing pin (6); the rifle further comprising at least one safety mechanism inhibiting the drive mechanism, wherein the at least one safety mechanism (15) comprises at least one of:

a safety lever (17) pivoted to the butt (3) and rotating with respect thereto at a back portion thereof, and an elastic element (19) countering rotation of the safety lever (17), wherein in a first position an end (20) of the safety lever engages a snap lever (13) and prevents the rotation thereof, thereby preventing activation of the firing pin (6) and, in a second position, the safety lever (17) does not engage the snap lever (13), thereby allowing the activation of the firing pin (6), switching from the first to the second position being caused by a user's palm as the user grasps the butt (3), by overcoming the force of the countering elastic element (19);

a safety button (21) at a front and upper portion of the butt (3), where a user's first finger is expected to be placed, movable between an active position, next which the safety button (21) engages the trigger (T) and prevents the rotation thereof, and an inactive position, corresponding to the button pressed towards the butt (3) by the first finger and to disengagement of the trigger (T), which is therefore free to rotate.

* * * * *